US009617801B2

(12) United States Patent
Tverlid

(10) Patent No.: US 9,617,801 B2
(45) **Date of Patent: *Apr. 11, 2017**

(54) DRILL PIPE PROTECTOR ASSEMBLY

(71) Applicant: STATOIL PETROLEUM AS, Stavanger (NO)

(72) Inventor: Steinar Wasa Tverlid, Bjørøyhamn (NO)

(73) Assignee: STATOIL PETROLEUM AS, Stavanger (NO)

( * ) Notice: Subject to any disclaimer, the term of this patent is extended or adjusted under 35 U.S.C. 154(b) by 251 days.

This patent is subject to a terminal disclaimer.

(21) Appl. No.: 14/539,724

(22) Filed: Nov. 12, 2014

(65) Prior Publication Data

US 2015/0068814 A1 Mar. 12, 2015

Related U.S. Application Data

(63) Continuation of application No. 13/060,935, filed as application No. PCT/EP2008/007103 on Aug. 29, 2008, now Pat. No. 8,905,161.

(51) Int. Cl.
*E21B 17/10* (2006.01)
*E21B 17/04* (2006.01)

(52) U.S. Cl.
CPC ..... *E21B 17/1078* (2013.01); *E21B 17/04* (2013.01); *E21B 17/10* (2013.01)

(58) Field of Classification Search
CPC ..... E21B 17/10; E21B 17/04; E21B 17/1078
See application file for complete search history.

(56) References Cited

U.S. PATENT DOCUMENTS

| | | | | |
|---|---|---|---|---|
| 1,788,630 A | | 1/1931 | Grant | |
| 2,288,124 A | * | 6/1942 | Creighton | E21B 17/1085 175/325.5 |
| 2,308,316 A | * | 1/1943 | Smith | E21B 17/1042 175/325.7 |
| 2,378,738 A | * | 6/1945 | Smith | E21B 17/1042 15/246 |
| 3,318,397 A | | 5/1967 | Combes | |
| 3,410,613 A | * | 11/1968 | Kuus | E21B 17/105 175/325.7 |
| 3,588,199 A | * | 6/1971 | Hopmans | E21B 17/1042 175/325.5 |
| 4,253,710 A | | 3/1981 | Goodman | |

(Continued)

FOREIGN PATENT DOCUMENTS

| | | |
|---|---|---|
| EP | 0 439 279 A1 | 7/1991 |
| GB | 271839 | 3/1928 |

(Continued)

*Primary Examiner* — Jennifer H Gay
(74) *Attorney, Agent, or Firm* — Birch, Stewart, Kolasch & Birch, LLP

(57) ABSTRACT

A drill pipe protector assembly comprising at least one protector sleeve (23) adapted to be mounted to the drill pipe string (7) through a fluid bearing (25) so as to be co-axially rotatable with respect to the drill pipe string (7). A retainer arrangement (21, 35) axially fixes the protector sleeve (23) with respect to the drill pipe string (7). The fluid bearing (25) is constructed according to the principles of a hydrostatic fluid bearing. At least one fluid channel (53) connects the fluid bearing (25) to a fluid path of pressurized drilling fluid flowing within an inner space (51) of the drill pipe string (7).

2 Claims, 6 Drawing Sheets

(56) References Cited

U.S. PATENT DOCUMENTS

| | | | | |
|---|---|---|---|---|
| 4,606,417 | A | | 8/1986 | Webb et al. |
| 4,989,679 | A | | 2/1991 | Amaudric Du Chaffaut |
| 5,069,297 | A | * | 12/1991 | Krueger ..... E21B 17/105 175/325.6 |
| 5,181,576 | A | | 1/1993 | Askew et al. |
| 5,232,058 | A | | 8/1993 | Morin et al. |
| 5,261,498 | A | | 11/1993 | Steinkamp et al. |
| 5,579,854 | A | | 12/1996 | Barry |
| 5,711,386 | A | | 1/1998 | Swietlik |
| 5,740,862 | A | | 4/1998 | Sable |
| 5,803,193 | A | * | 9/1998 | Krueger ..... E21B 17/1064 166/241.6 |
| 5,833,018 | A | | 11/1998 | Von Gynz-Rekowski |
| 5,901,798 | A | | 5/1999 | Herrera et al. |
| 6,655,477 | B2 | | 12/2003 | Appleton et al. |
| 6,935,442 | B2 | | 8/2005 | Boulet et al. |
| 2002/0023782 | A1 | | 2/2002 | Appleton et al. |
| 2002/0129976 | A1 | | 9/2002 | Rastegar |
| 2004/0026131 | A1 | | 2/2004 | Boulet et al. |
| 2004/0163852 | A1 | | 8/2004 | Broom |
| 2011/0198132 | A1 | | 8/2011 | Tverlid |
| 2012/0199400 | A1 | | 8/2012 | Boulet et al. |
| 2015/0068814 | A1 | * | 3/2015 | Tverlid ..... E21B 17/10 175/325.3 |

FOREIGN PATENT DOCUMENTS

| | | | |
|---|---|---|---|
| GB | 2 400 124 | A | 10/2004 |
| WO | WO 95/10685 | A2 | 4/1995 |
| WO | WO 97/21117 | A1 | 6/1997 |

* cited by examiner

DRILL PIPE PROTECTOR ASSEMBLY

CROSS-REFERENCE TO RELATED APPLICATION

This application is a Continuation of U.S. patent application Ser. No. 13/060,935 filed on Apr. 28, 2011 (now U.S. Pat. No. 8,905,161 issued on Dec. 9, 2014), which is the National Phase of PCT/EP2008/007103 filed on Aug. 29, 2008, all of which are hereby expressly incorporated by reference into the present application.

BACKGROUND OF THE INVENTION

1. Field of the Invention

The invention relates to a protector assembly to be mounted to a drill pipe string extending along the bore of a well, for example an oil and/or gas well.

2. Background of the Invention

When drilling the bore hole of an oil and/or gas well, the friction between the drill pipe string and the open hole or the casing lining the hole limits the reach of the drilling action in particular if the drill pipe string is subject to lateral deflection, for example when drilling along a curved or angled path. Contact between the drill pipe string and the bore hole or its casing creates frictional torque and drag and limits the weight that can be put on the drilling bit and the effective control of the weight. In addition, the drill pipe string is subjected to increased shock and abrasion with a likelihood of damage to the drill pipe string or the casing. Shocks and vibrations occurring at the drill pipe string reduce the accuracy of the well bore.

To reduce friction between a drill pipe string and the bore hole or its casing, it is known from GB-A-2 400 124 to provide the drill pipe string with a plurality of protector sleeves rotatably mounted each on a different section of the drill pipe string. Each protector sleeve has an outer diameter greater than the outer diameter of joints connecting adjacent drill pipe sections and is rotatably seated on the outer diameter of the drill pipe section axially between a pair of thrust bearings axially fixing the protector sleeve with respect to the drill pipe section.

During drilling operation, pressurized drilling fluid flows through the drill pipe string down to the drilling bit and returns to the surface level through the annular space (annulus) between the drill pipe string and the bore hole or its casing, respectively. To reduce the friction between the protector sleeve and the drill pipe section, the radially inner surface of the prior art protector sleeve is provided with a plurality of longitudinal grooves extending along the protector sleeve to allow the drilling fluid to bypass the protector sleeve and to thus "lubricate" the protector sleeve when rotating relatively to the drill pipe section.

The drilling fluid flowing to the surface level of the well contains abrasive mud which limits the useful life of the protector sleeve and limits the degree of reduction of friction since it is hardly possible to make fully use of the friction reducing capacities of a fluid bearing.

Similar drill pipe protector assemblies are known from WO 95/10 685 A and EP 0 439 279 A1. From WO 95/10 685 A and U.S. Pat. No. 5,740,862 it is further known to seal a protector sleeve relatively to the outer diameter of the drill pipe section rotatably carrying the protector sleeve and to lubricate the protector sleeve by oil or grease included in an annular gap radially between the drill pipe and the protector sleeve.

SUMMARY OF THE INVENTION

Generally spoken, it is an object of the invention to reduce friction between a drill pipe string and a bore hole or its casing of an oil and/or gas well. Reduction of friction will allow a higher percentage of energy put on to the drill string by a surface level drive to reach the drill bit. Further, the reduction of friction will significantly reduce drilling instability and therefore will improve the quality of the bore hole and will reduce stresses on the formation. The reduction of friction will also increase the reach of drilling the well, and will allow better hole cleaning.

Under a first aspect, it is an object of the invention to reduce friction between the drill pipe string and a protector sleeve rotatably mounted thereon.

Under the first aspect, the drill pipe protector assembly comprises a protector sleeve adapted to be mounted to a drill pipe string through a fluid bearing so as to be co-axially rotatable with respect to the drill pipe string and a retainer arrangement adapted to axially fix the protector sleeve with respect to the drill pipe string. The drill pipe protector assembly is characterized by at least one fluid channel connecting the fluid bearing to a fluid path of pressurized drilling fluid within the drill pipe string.

The drilling fluid flowing under pressure within the drill pipe string is "fresh" (clean) drilling fluid with the mud and abrasive substances being removed at the surface level of the well. Thus the fluid bearing can easily be constructed according to the principles of hydrostatic fluid bearings to minimize friction. Preferably, a plurality of fluid channels are provided distributed in circumferential direction of the drill pipe to provide for a stable operation of the fluid bearing. Preferably, the fluid channels are throttle bores reducing the fluid pressure within the fluid bearing with respect to the pressure of the drilling fluid within the drill pipe. The throttling action of the fluid channels lowers and equalizes the pressure in the fluid bearing with respect to the pressure of the drilling fluid within the drill pipe preferably to a pressure value providing a load carrying capacity of the fluid bearing with no or only negligible mechanical contact between bearing surfaces of the fluid bearing.

To prevent back flow of "dirty" drilling fluid from the annulus of the well bore through the fluid bearing to the drill pipe in a preferred embodiment, the at least one fluid channel contains a check valve which allows the drilling fluid to pass in a direction from within the drill pipe to the fluid bearing, and which closes in the opposite direction. Such back flow may occur due to pressure fluctuations and in particular in a well-out-of-control situation e.g. a "kick" situation of the well.

According to the general object of the invention, there is not only the aim to minimize the friction of the protector sleeve relatively to the drill pipe, but also relatively to the casing or the bore hole surrounding the protector sleeve, in particular during axial movement of the protector sleeve with respect to the bore hole or its casing. In a preferred embodiment of the protector assembly according to the invention, the protector sleeve comprises on its outer circumferential contour a plurality of radially open ports connected to the fluid bearing to radially discharge drilling fluid, wherein at least two of the ports are staggered in the circumferential direction of the protector sleeve. The drilling fluid exiting the ports provide for a defined lubrication between the protector sleeve and the surrounding wall of the bore hole or its casing. The fluid channels connecting the fluid bearing to the fluid path of pressurized drilling fluid within the drill pipe provide for a defined pressure and compensate for drilling fluid which was exited through the ports. Since the ports are distributed around the protector sleeve, it is not necessary to provide for complicated stabilizing means maintaining the fluid ports in a downward direction as described for example in GB 2400 124 A.

Preferably, the ports are arranged in at least two groups of ports, wherein each groups comprises a plurality of ports arranged in an axial extending row of ports, and wherein the groups of the ports are staggered in the circumferential direction of the protector sleeve. In this embodiment, the drilling fluid exiting the ports does not only reduce friction while axially moving the protector sleeve relatively to the bore hole wall or the casing, but also to some extent during a relative rotational movement between the protector sleeve and the surrounding wall.

According to the principle of a hydrostatic fluid bearing, pressurized drilling fluid is supplied to the fluid bearing and is allowed to leak out from the bearing normally at one or both axial ends of the fluid bearing. To better define pressure and quantity of the flow of drilling fluid exiting through the ports, there is provided in a preferred embodiment a pair of sealing arrangements at an axial distance from each other for axially sealing the fluid bearing provided therebetween. The sealing arrangements can be made as described hereinafter under a second aspect of the invention.

As it is usual with a fluid bearing, the protector sleeve must have a certain radial play with respect to the drill pipe to allow the protector sleeve to "float" on a fluid film independent of whether the fluid bearing is a bearing of a hydrostatic type with externally pressurized fluid or of a hydrodynamic type with a sealed volume of fluid pressurized by the pumping action of a pair of bearing surfaces of the fluid bearing rotating relatively to each other.

Prior art drill pipe protector assemblies as described for example in WO 95/10 685 A or U.S. Pat. No. 5,740,862 comprise elastic O-ring sealings axially on both sides of a bearing gap of the fluid bearing. The O-ring sealings are radially stressed and provide for friction losses.

Under a second aspect, it is an object of the invention to lower friction losses of a drill pipe protector assembly caused by sealings of the protector assembly.

Also under the second aspect, the drill pipe protector assembly comprises a protector sleeve adapted to be mounted on a drill pipe string through a fluid bearing so as to be co-axially rotatable with respect to the drill pipe string and further comprises a retainer arrangement adapted to axially fix the protector sleeve with respect to the drill pipe string. The fluid bearing comprises a pair of bearing components being co-axially arranged to form a pair of bearing surfaces radially opposite to each other with a bearing gap containing a lubrication fluid therebetween and further comprises a pair of sealing arrangements at an axial distance from each other for sealing the bearing gap provided therebetween. The lubrification fluid preferably is oil or grease.

According to the invention under the second aspect, each sealing arrangement comprises at least one labyrinth type sealing having an annular groove in a first one of the bearing components and at least one ring member sealingly seated to a second one of the bearing components, wherein the at least one ring member radially extends with radial play into the annular groove associate thereto.

The sealing arrangement of this type allows radial play movement of the bearing components relatively to each other even if a contact pressure between surfaces of the ring member and the annular groove associated thereto is low or negligible to lower friction losses of the sealing. Though the sealing arrangement according to the second aspect is useful with a hydrostatic type fluid bearing, the preferred use is with a fluid bearing constructed according to the principles of hydrodynamic type fluid bearings.

The ring member can be a closed ring sealingly fixed to the second bearing component. In order to also allow an axial play between the bearing components, the ring member is preferably in the form of a slotted radially resilient ring having a slot which radially extends through the ring.

The ring is seated with radial play within the annular groove of the first bearing component and provides for a resilient radial sealing contact with the second bearing component.

To also seal the slot of the ring, at least two rings are provided within the same annular groove with their slots being staggered in the circumferential direction to seal the gap at the slots. Preferably, stop means are provided to prevent relative rotation of the rings.

In a preferred embodiment, the slot is a stepped slot having a slot portion which extends in circumferential direction of the ring. The slot portion provides for abutting surfaces which axially seal the slot.

In a preferred embodiment, each sealing arrangement comprises at least two labyrinth type sealings arranged at an axial distance from each other to provide for a cascade of sealings. Preferably a viscous fluid is provided axially between adjacent labyrinth type sealings. The viscous fluid preferably has a consistency which is more viscous than the lubrification fluid within the bearing gap of the fluid bearing. Viscous oil or grease is suitable.

It is known for example from EP 0 439 279 A1 or WO 95/10 685 A1 to axially fix a protector sleeve rotatably mounted on a drill pipe through a fluid bearing by means of a retainer arrangement. The fluid bearing of the known drill pipe protector assembly comprises a pair of bearing components being co-axially arranged to form a pair of bearing surfaces radially opposite to each other with a bearing gap containing a lubrification fluid therebetween. The protector sleeve comprises an annular recess having a bottom surface forming a first one of the pair of bearing surfaces of the bearing gap and further comprises annular inner side surfaces on axially opposite sides of the bottom surface. The retainer element comprises an annular protrusion body which radially extends into the annular recess and has an outer circumferential surface forming a second one of the pair of bearing surfaces of the bearing gap and also has annular outer side surfaces on axially opposite sides of the outer circumferential surface. The side surfaces of the protrusion body and of the annular recess each extend in planes rectangular to the axis of rotation of the protector sleeve and form axial stop faces limiting the axial movement play of the protector sleeve with respect to the protrusion body. The side faces do not contribute to the radial load bearing capacity of the fluid bearing.

Under a third aspect of the invention, it is in an object to improve the radial load bearing capacity of the drill pipe protector assembly.

According to the third aspect of the invention, the inner and outer side surfaces of the annular recess of the protector sleeve and of the annular protrusion body, respectively, each have a frustoconical shape and form in pairs second frustoconical bearing gaps containing lubrification fluid. The frustoconical bearing gaps contribute to the load bearing capacity in radial direction and further form low friction axial stops or axial load bearings fixing the protector sleeve with respect to the protrusion and thus to the drill pipe. Of course in a variant of the third aspect, the annular recess may be provided in the retainer arrangement and the annular protruding body can be associated to the protector sleeve.

In a preferred embodiment, a pair of sealing arrangements is provided at an axial distance from each other for sealing both the first mentioned bearing gap and the lateral second bearing gaps in between the pair of sealing arrangements. The sealing arrangements may have the form of elastic O-ring sealings, but preferably are constructed according to the principles of the second aspect of the invention.

The protector assembly as explained under the first aspect of the invention allows decreasing friction between the protector sleeve and the bore hole or its casing in case of relative axial movement by means of ports through which drilling fluid can exit to lubricate the outer contour of the protector sleeve similar to an hydrostatic fluid bearing.

Another possibility to lower friction between the outer contour of the protector sleeve and the surrounding bore hole or casing, respectively, is characterized in that the protector sleeve at a radial distance from its outer surface is provided with a plurality of channels which are distributed in circumferential direction of the protector sleeve and which axially extend therethrough. The protector sleeve further comprises endless bands each of which is made of a flexible friction-reducing material and extends axially moveably through an associated one of the channels such that the endless band axially extends along the outer surface of the protector sleeve. The endless band can scroll along the outer surface of the protector sleeve and through the associated channel. The materials of the endless band and the outer surface of the protector sleeve are chosen to minimize friction therebetween even in case the endless band sticks to the casing while the drill pipe moves in axial direction. The friction-reducing endless band can be provided under any one of the aspects of the invention as explained above.

Preferably, the protector sleeve is provided with a plurality of radially protruding ribs extending in axial direction so that the drilling fluid flowing back to the surface level of the well may flow through the spaces between the ribs. Preferably, the endless bands extend through channels provided in the ribs.

To provide for a certain supply of lubrification fluid within the fluid bearing and to provide for uniform distribution of the fluid throughout the bearing gap of the fluid bearing, at least one of a pair of bearing surfaces forming the bearing gap of the fluid bearing is provided with at least one annular groove.

The protector sleeve and the retainer arrangement, in particular the retainer body thereof, may be divided into two sections detachably fixed to each other so that the retainer arrangement and the protector sleeve may be mounted to and dismounted from the drill pipe as it is known for example from EP 0 439 279 or GB 2 400 124 A.

Dividable protector assemblies of desirable robustness are costly. To provide for a robust but less costly protector assembly, the retainer arrangement may be in form of a coupling pipe member having couplings to be joined with corresponding couplings of drill pipe sections on axially both ends. A coupling pipe member of this type, the axial length of which is shorter than the axial length of a section of the drill pipe string, may be inserted in between adjacent drill pipe sections so that the retainer arrangement and the protector sleeve must not be dissembled for making connections of drill pipe section. Preferably, a plurality of protector sleeves is rotatably mounted on the coupling pipe member in order to increase the radial load carrying capacity.

BRIEF DESCRIPTION OF THE DRAWINGS

Embodiments of the invention will now be described by way of example, with reference to the accompanying drawings wherein.

DETAILED DESCRIPTION OF THE PREFERRED EMBODIMENTS

Figure 1:
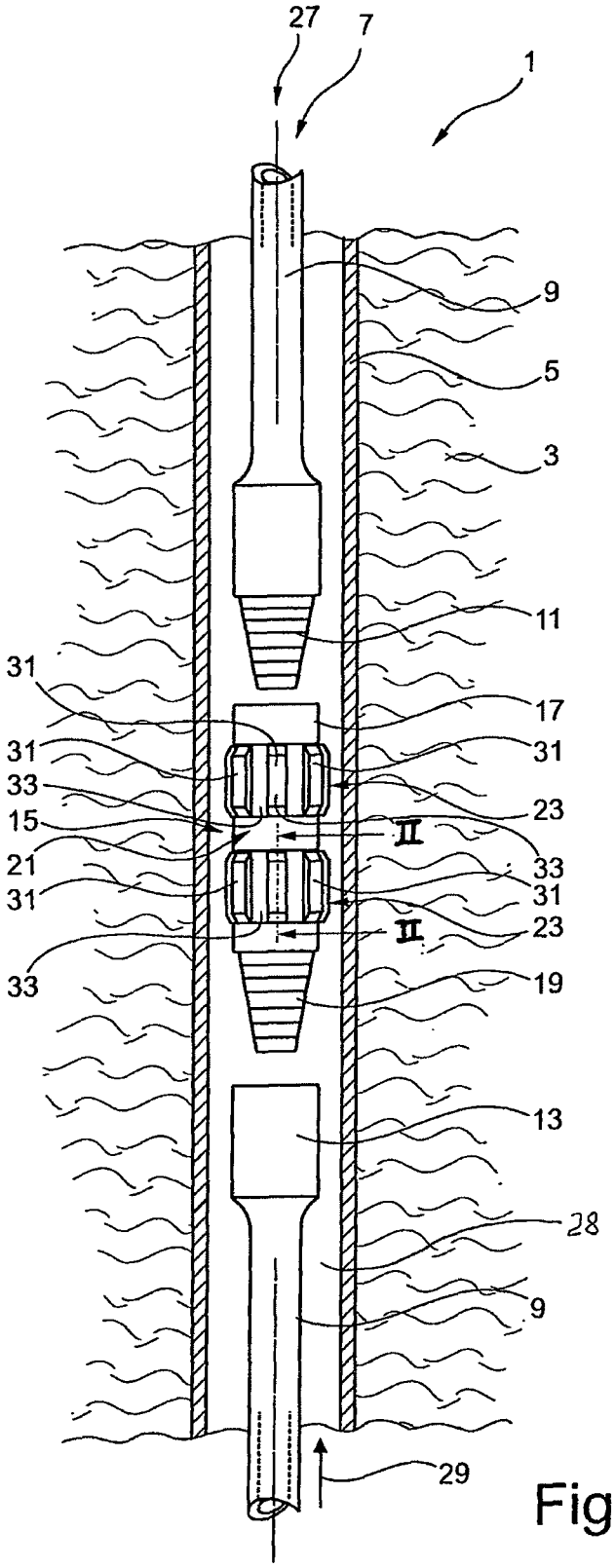
FIG. 1 is a schematic sectional side view through a portion of a drill pipe string provided with a protector assembly in a well bore with the drill pipe string and the protector assembly shown in an exploded view.

FIG. 1 shows a bore hole 1 of an oil and/or gas well within a formation 3 which is lined with a casing 5 and a drill pipe string 7 longitudinally extending through the bore hole 1 and its casing 5. The drill pipe string 7 comprises a plurality of drill pipe sections 9, each having complementary joint couplings 11, 13 at both ends for releasably coupling adjacent drill pipe sections 9. The drill pipe section 9 on the surface level is coupled to a drilling drive (not shown) while the bottommost drill pipe section 9 carries a drilling bit (also not shown). The drill pipe string 7 is shown in an exploded view for better demonstration of the joint couplings 11, 13.

In order to reduce friction between the drill pipe sections 9 and in particular its joint couplings 11, 13 and the surrounding wall of the bore hole 1 or its casing 5, a protector assembly 15 in the form of a coupling pipe member is inserted in between the joint couplings 11, 13 of adjacent drill pipe sections 9. The protector assembly 15 has joint couplings 17, 19 similar to the couplings 11, 13. Coupling 17 corresponds to coupling 13 and can be coupled to coupling 11 of the pipe section 9 while coupling 19 corresponds to coupling 11 and can be detachably coupled to coupling 13 of the pipe section 9. The protector assembly 15 prevents direct contact of the couplings 11, 13 to the inner surface of the bore hole 1 or its casing 5 and thus prevents damage to the couplings 11, 13 or to the bore hole 1 and its casing 5.

The protector assembly 15 comprises a retainer pipe 21 provided on its opposite ends with the couplings 17, 19. On its outer circumference the retainer pipe 21 carries two protector sleeves 23 co-axially rotatable each by means of a fluid bearing 25 as explained hereinafter with reference to FIG. 2. The protector sleeves 23 are axially fixed with respect to the retainer pipe 21 and have an outer diameter which is larger than the outer diameter of the drill pipe sections 9 and in particular of the couplings 11, 13, 17 and 19.

Of course, the protector assembly 15 may comprise only one protector sleeve but also more than two protector sleeves depending on the load carrying purposes. While the protector sleeves 23 are provided on a retainer pipe 21 forming a coupling pipe member, in a variant of this embodiment at least one protector sleeve may be mounted rotatably but axially fixed on the drill pipe section 9 itself, (not shown). The protector sleeve may be in the form of sections (not shown) detachably hinged or connected to each other to allow mounting of the protector sleeve to the retainer pipe or the drill pipe section of the drill pipe string.

Within the drill pipe string 7 including the retainer pipe 21, drilling fluid flows from the surface level (not shown) of the well down to the drilling bit (not shown) as indicated by an arrow 27 in FIG. 1. In the annular space 28 (annulus) radially between the drill pipe string 7 and the casing 5 the drilling fluid carrying drilling mud and abrasives flows back to the surface level (arrow 29) where the drilling fluid is filtered and cleaned for re-use. To enable the back flow of drilling fluid, each protector sleeve 23 on its outer circumference is provided with a plurality of axially extending ribs 31 distributed around the protector sleeve 23. Grooves 33 between adjacent ribs 31 allow the drilling fluid to pass by even if ribs 31 are contacting the casing 5.

Figure 2:
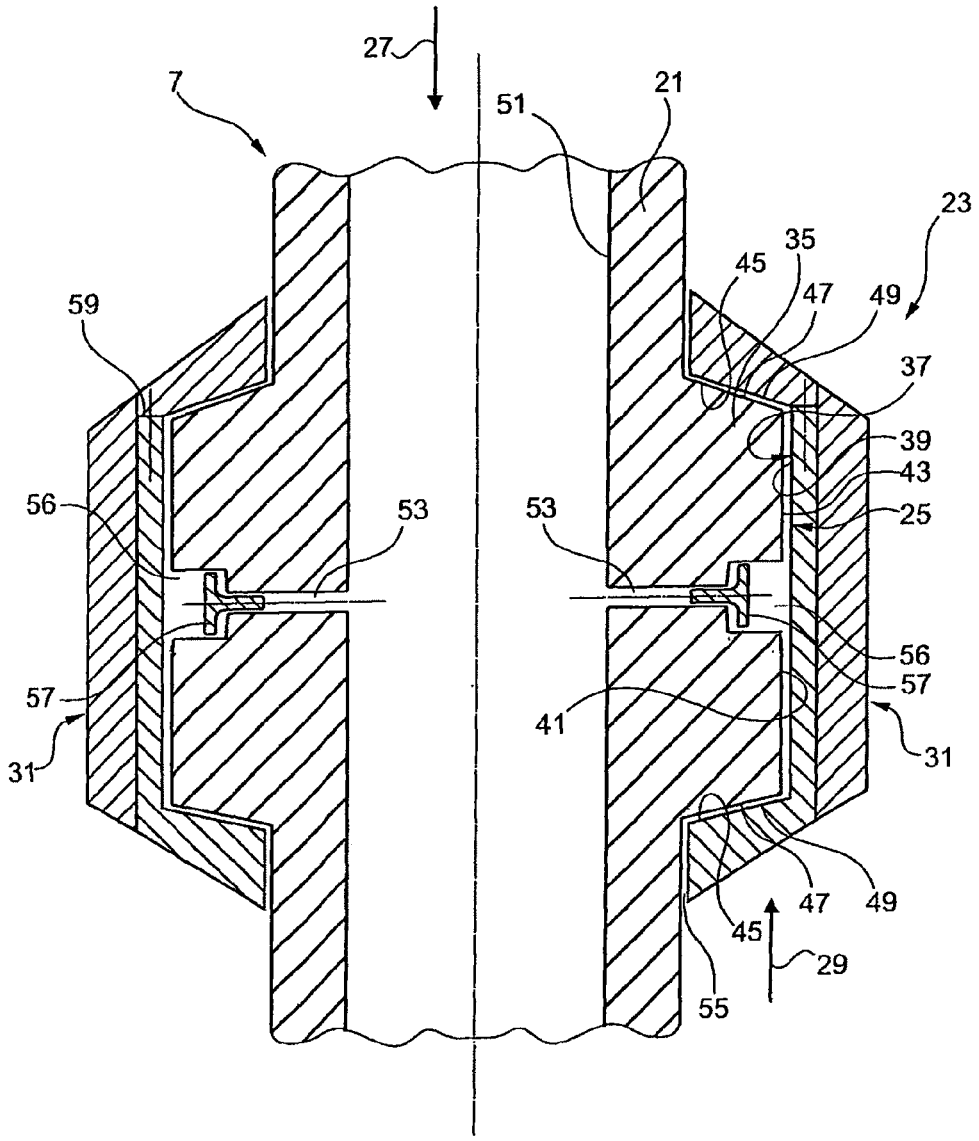
FIG. 2 is a schematic sectional view of a detail of the protector assembly shown along a line H-I1 in FIG. 1.

As shown in FIG. 2, the protector sleeve 23 is mounted rotatably but stationary in axial direction on an annular protrusion body 35 which is fixed to or integral with the retainer pipe 21. The protrusion body 35 radially extends into an annular recess 37 on the inner side of the protector sleeve 23. The annular recess 37 has a cylindrical bottom surface 39 radially opposite a cylindrical outer surface 41 of the protrusion body 35. The surfaces 39, 41 form bearing surfaces of the fluid bearing 25 and limit a radial bearing gap 43 radially therebetween.

Axially on both sides, both the annular recess 37 of the protector sleeve 23 and the annular protrusion body 35 of the retainer pipe 21 have side surfaces 45 and 47, respectively, which in pairs form stop faces to axially fix the protector sleeve 23 relatively to the retainer pipe 21. Further, the pair of side faces 45, 47 show an axial play and form lateral bearing gaps which are open to the bearing gap 43 at their radially outer circumference. Corresponding to a frustoconical shape of the side faces 45, 47 the lateral bearing gaps also have a frustoconical shape with the bearing gaps 49 being inclined towards each other in the radial outward direction. The bearing gaps 49 form lateral axial fluid bearings which due to the frustoconical shape of their bearing gaps 49 do not only provide for an axial load carrying capacity, but also improve the radial load bearing capacity of the fluid bearing 25.

In a variant of the embodiment shown in FIG. 2, the side surfaces 45, 47 may stand rectangularly to the axis rotation of the protector sleeve 23.

The fluid bearing 25 is constructed along the principles of a hydrostatic fluid bearing using the pressurized drilling fluid flowing within an inner space 51 of the drill pipe string 7 and the retainer pipe 21, to lubricate the fluid bearings 25, 49 with the "clean" drilling fluid from inside the drill pipe string 7. The bearing gap 43 of the fluid bearing 25 is connected via at least one, but preferably a plurality of radial channels 53 to the inner space 51. Drilling fluid entering into the bearing gap 43 and the lateral bearing gaps 49 can leak through radial play gaps 55 at the radial inner ends of the lateral bearing gaps 49.

The channels 53 provide for a throttling action and thus to a uniform load carrying capacity. The channels 53 at their radial outer ends communicate with an annular groove 56 distributing and uniformly supplying the drilling fluid to the bearing gap 37. To prevent abrasive "dirty" drilling fluid entering the inner space 51 from outside of the retainer pipe 21, e.g. in particular from the annular space 28 through the channels 53 due to fluctuations of the pressure or in particular a well-out-of-control situation, e.g. a "kick" situation of the well, a check valve 57 is associated with each of the channels 53.

The check valve 57 allows the drilling fluid to pass in a direction from the inner space 51 to the fluid bearing 25, but closes in the opposite direction. The check valve 57 may be resiliently pre-stressed in the closing direction and preferably seated in the groove 56.

As shown in FIG. 2, the protector sleeve 23 is of a two-piece construction axially dividable at 59 to allow inserting the protrusion body 35 into the recess 37. Of course, in a variant of the protector sleeve 23 or the protrusion body 35, the protector sleeve 23 may be divided in circumferential direction (not shown).

The fluid bearing 25 minimizes friction between the protector sleeve 23 and the drill pipe string 7. To also decrease friction between the drill pipe string 7 and the casing 5 during axial movement of the drill pipe string 7, the ribs 31 mounted on the outer circumference of the protector sleeve 23 are made of a friction reducing material, for example plastics material having a low friction co-efficient.

Below, further embodiments of a drill pipe protector assembly according to the invention will be described. Components of the same effect or same construction will be described with reference numerals used with FIGS. 1 and 2. For the description of these components, their operation and advantages reference is made to the description above.

Figure 3:
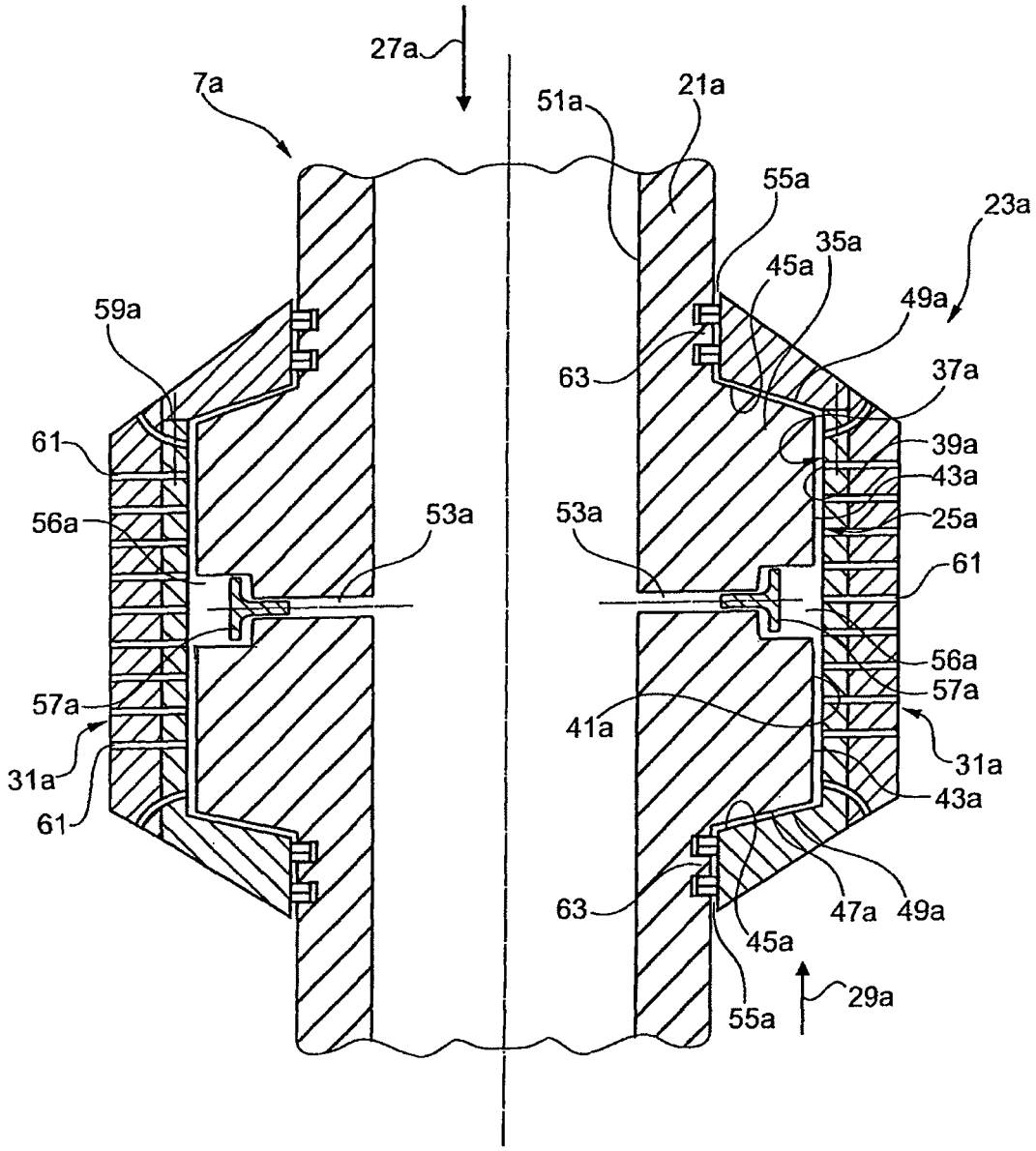
FIGS. 3 to 5 show schematic sectional views of variants of the protector assembly similar to the sectional view in FIG. 2, and FIGS. 6 and 7 show perspective views of details of preferred embodiments of a sealing arrangement which can be used in the protector assemblies shown in FIGS. 3 to 5.

FIG. 3 shows a drill pipe protector assembly similar to the embodiment of FIG. 2. The protector assembly also comprises protector sleeves 23*a* rotatable via a hydrostatic type fluid bearing lubricated by drilling fluid from inside the drill pipe string 7*a* as shown in FIG. 1. In order to lower friction between the drill pipe string and the bore hole or its casing during axial movement of the drill pipe string, the protector sleeve 23*a* is provided with a plurality of ports 61 at its outer contour. The ports 61 are connected to the bearing gap 43*a* of the fluid bearing 25*a* and allow leakage of the drilling fluid to the outside of the protector sleeve 23*a* for lubricating an area of contact between the protector sleeve 23*a* and the bore hole or its casing. Since the drilling fluid exits the ports 61 in radial direction, the reaction forces of the radial stream of drilling fluid lower the contact pressure between the drill pipe string 7*a* and its surrounding wall of the bore hole thus lowering the friction during axial movement of the drill pipe string 7*a*.

The ports 61 are arranged in an axially extending row along preferably each of the ribs 31*a* which are distributed in the circumferential direction of the protector sleeve 23*a*. To prevent leakage of the drilling fluid through the annular gaps 55*a*, sealing arrangements 63 are provided on axially both ends of the protector sleeve 23*a*. The sealing arrangements 63 can be customarily constructed, for example in the form of elastic O-rings, but preferably they are provided in the form of labyrinth type sealings as explained below with respect to FIG. 4.

Figure 4:
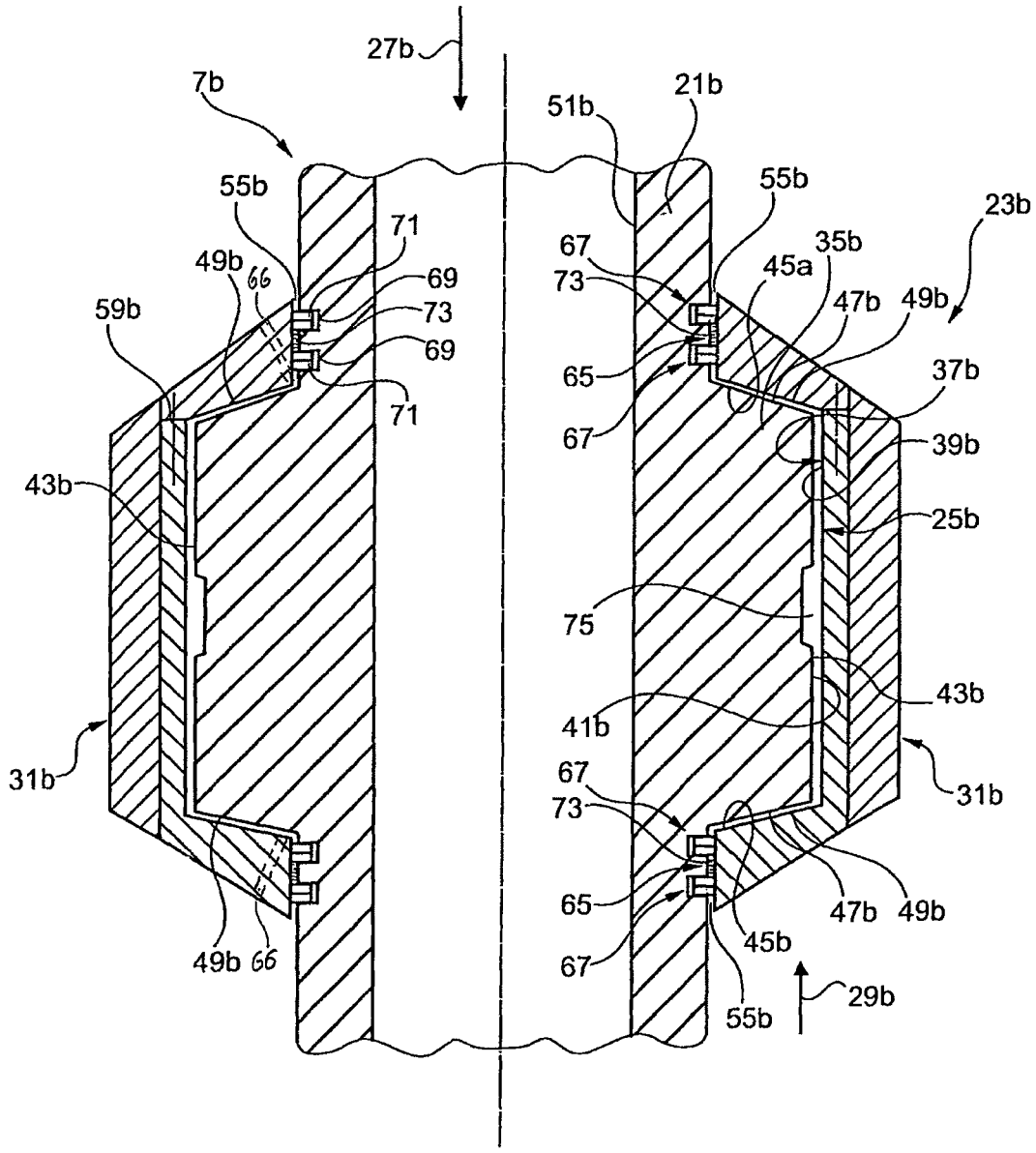

The embodiment of FIG. 4 differs from the embodiment shown in FIGS. 1 and 2 primarily in that the fluid bearing 25*b* is a bearing constructed according to the principles of a hydrodynamic type fluid bearing with its bearing gaps 43*b* and lateral bearing gaps 49*b* containing a lubrication fluid such as oil or grease. The bearing gaps 43*b* and 49*b* are arranged between a pair of sealing arrangements 65 at the axial ends of the protector sleeve 23*b* to seal the annular gaps 55*b* between the protector sleeve 23*b* and the outer circumference of the retainer pipe 21*b*. The hydrodynamic fluid pressure carrying the protector sleeve 23*b* with respect to the retainer pipe 21*b* and thus the drill pipe string 7*b* is effective only during relative rotational movement between the protector sleeve 23*b* and the retainer pipe 21*b*. Nipplelike closable ports 66 at axially opposite positions of the protector sleeve 23*b* allow filling of the bearing gaps 43*b*, 49*b* with lubrification fluid while venting the gaps.

The principle of a hydrodynamic fluid bearing necessitates a certain radial play between the protector sleeve 23*b* and the retainer pipe 21*b*. Though the sealing arrangements 65 may consist of a simple flexible O-ring sealing, such an O-ring sealing may raise friction in particular due to raising stress due to radial displacement of the protector sleeve relatively to the retainer pipe. To minimize friction, each of the sealing arrangements 65 comprises a pair of labyrinth type sealings 67 comprising an annular groove 69 in the outer circumference of the retainer pipe 21*b* and a ring member 71 which is sealingly fixed or seated to the protector sleeve 23*b*. The ring member 71 radially extends with radial play into the annular groove 69 associated thereto. The annular gap 55*b* axially between the labyrinth type sealings 67 is filled with a viscous lubricant 73 which is more viscous than the lubricant contained in the bearing gaps 43*b*, 49*b* to improve the sealing action of the sealing arrangements 65. In a variant (not shown) of FIG. 4, the grooves 69 may also be provided in the protector sleeve 23*b*, while the ring members 71 are fixed to the outer circumference of the retainer pipe 21*b*. The number of labyrinth type sealings 67 may vary from one to more than two sealings in each of the sealing arrangements 65.

Figure 6:
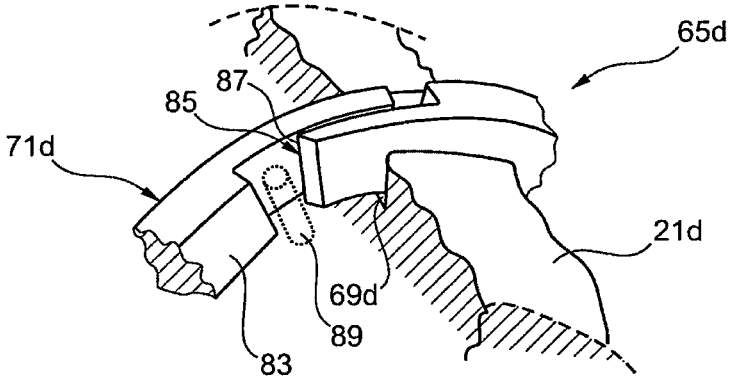
Figure 7:
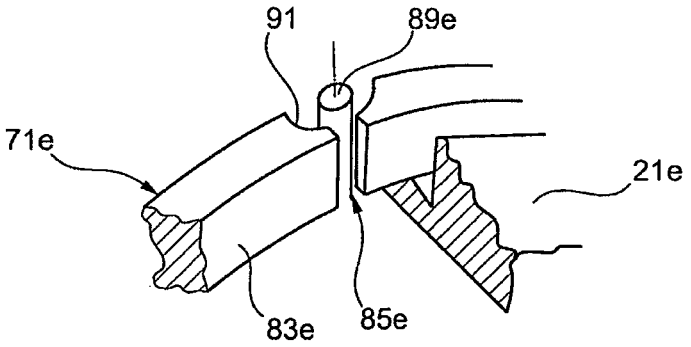

As described in detail with respect to FIGS. 6 and 7, the ring member 71 comprises at least one slotted, radially resilient ring which is radially moveably caged within the annular groove 69. The ring is resiliently seated to the inner circumference of the protector sleeve 23*b*, such that the protector sleeve 23*b* can axially move within a certain axial play relatively to the retainer pipe 21*b*. Of course, in case of a non-slotted ring, the ring may be fixed to the protector sleeve 23*b*. In order to prevent leakage through the slot of the ring, at least two rings may be provided side by side within the annular groove 69 with the slots of the rings being staggered in circumferential direction.

In order to provide for a supply of lubricant at the bearing gaps 43*b*, 49*b*, at least one annular groove as shown at 75 may be provided on one of the bearing surfaces 39*b* or 41*b*.

Figure 5:
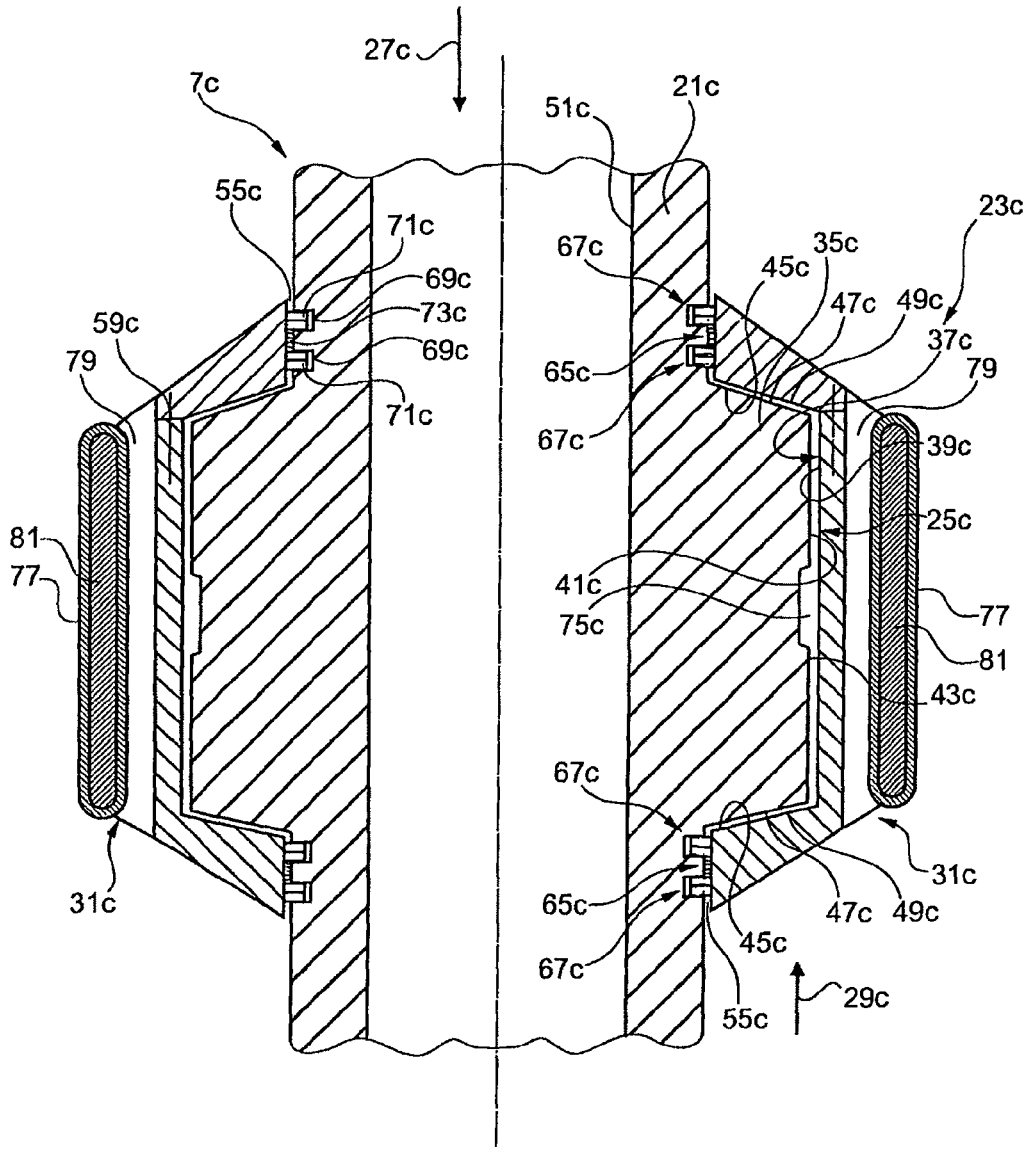

FIG. 5 shows a variant of the drill protector assembly of FIG. 4. The variant differs from the embodiment of FIG. 4 basically in the fact that the ribs 31*c* carry an endless belt or band 77 to minimize friction if the drill pipe string 7*c* moves axially along the bore hole or its casing.

Each rib 31*c* is provided with a channel 79 longitudinally extending therethrough. The endless band 77 moveably encircles a web 81 of the channel 79 and is made of a flexible low-friction material showing low friction in particular with respect to the radial outer surface of the web 81 when sliding the along the web 81. Though the endless band 77 can slide along the bore hole or its casing, there is a defined low friction between the endless band 77 and the rib 31*c*.

FIG. 6 shows details of a sealing arrangement 65*d* which can be used with drill protector assemblies as shown in the FIGS. 3 to 5. The ring member 71*d* of the sealing arrangement 65*d* comprises a slotted, radially resilient ring 83 which is caged in the annular groove 69*d* of the retainer pipe 21*d*. The ring 83 is radially moveable within the groove 69*d* and is radially compressed while being radially seated on the inner surface of the protector sleeve which is not shown in FIG. 6 for better understanding of the construction of the ring 83.

The ring 83 has a stepped slot 85 which radially extends through the ring 83. The stepped slot 85 has a slot portion 87 which extends in circumferential direction in a plane normal to the axis of rotation of the protector sleeve 23*d* in order to axially seal the ring 83.

FIG. 6 shows an embodiment of the sealing arrangement 65*d* with only one ring 83 seated in the annular groove 69*d*. Of course, two or more rings 83 may be provided within the groove 69*d*, preferably with its stepped slots 85 staggered in circumferential direction. Stops as shown at 89 can be provided to fix the rings 83 relatively to each other.

FIG. 7 shows a ring member 71 e which may be used as a variant to ring member 71*d* in FIG. 6. The ring member 71 e also comprises a slotted, radially resilient ring 83*e* to be seated in the annular groove 69*e* of the retainer pipe 21*e*. The ring 83*e* has a slot 85*e* which radially and axially extends through the ring 83*e*. To prevent leakage through the slot 85*e*, at least two rings 83*e* are caged within the annular groove 69*e* of the retainer pipe 21*e* in a side by side manner with the slots 85*e* staggered in circumferential direction. In order to rotationally fix the ring 83*e* with respect to the retainer pipe 21*e*, one of the surfaces of the ring 83*e* comprises a recess 91 with the stop 89*e* protruding into the recess 91. In the embodiment of FIG. 7, the recess 91 radially overlaps the slot 85*e* so that the stop 89*e* at least partially closes the gap of the slot 85*e*.

The invention claimed is:

1. A drill pipe protector assembly, comprising:

a protector sleeve adapted to be mounted to a drill pipe string through a fluid bearing so as to be co-axially rotatable with respect to the drill pipe string; and a retainer arrangement adapted to axially fix the protector sleeve with respect to the drill pipe string, wherein the fluid bearing comprises a pair of bearing components being co-axially arranged to form a pair of bearing surfaces radially opposite to each other with a first bearing gap containing a lubrication fluid therebetween, wherein the protector sleeve comprises an annular recess having a bottom surface forming a first one of the pair of bearing surfaces of the first bearing gap and annular inner side surfaces on axially opposite sides of the bottom surface, wherein the retainer element comprises an annular protrusion body radially extending into the annular recess and having an outer circumferential surface forming a second one of the pair of bearing surfaces of the first bearing gap and annular outer side surfaces on axially opposite sides of the outer circumferential surface, wherein the inner and the outer side surfaces each have a frustoconical shape and form in pairs second frustoconical annular bearing gaps containing lubrication fluid, and wherein an angle between one of the annular inner side surfaces and one of the two axially opposite sides of the bottom surface is equal to an angle between the other one of the annular inner side surfaces and the other one of the two axially opposite sides of the bottom surface.

2. The drill pipe protector assembly as claimed in claim 1, wherein a pair of sealing arrangements is provided at an axial distance from each other for sealing the first bearing gap and the second bearing gaps in between the pair of sealing arrangements.

* * * * *